US007220715B2

(12) United States Patent
Ghosh et al.

(10) Patent No.: US 7,220,715 B2
(45) Date of Patent: May 22, 2007

(54) FABRIC CARE COMPOSITIONS FOR LIPOPHILIC FLUID SYSTEMS INCORPORATING AN ANTIMICROBIAL AGENT

(75) Inventors: Chanchal Kumar Ghosh, West Chester, OH (US); John Christian Haught, West Chester, OH (US)

(73) Assignee: The Procter & Gamble Co., Cincinnati, OH (US)

( * ) Notice: Subject to any disclaimer, the term of this patent is extended or adjusted under 35 U.S.C. 154(b) by 0 days.

(21) Appl. No.: 11/352,804

(22) Filed: Feb. 13, 2006

(65) Prior Publication Data

US 2006/0123562 A1 Jun. 15, 2006

Related U.S. Application Data

(63) Continuation of application No. 10/877,539, filed on Jun. 25, 2004, now abandoned.

(60) Provisional application No. 60/483,350, filed on Jun. 27, 2003.

(51) Int. Cl.
*C11D 9/36* (2006.01)
*C11D 1/825* (2006.01)
*C11D 3/30* (2006.01)

(52) U.S. Cl. ..... 510/285; 510/276; 510/286; 510/289; 510/304; 510/332; 510/338; 510/356; 510/382; 510/388; 510/407; 510/413; 510/466

(58) Field of Classification Search ..... 510/276, 510/285, 286, 289, 304, 332, 338, 356, 382, 510/388, 407, 413, 466
See application file for complete search history.

(56) References Cited

U.S. PATENT DOCUMENTS

| | | | | |
|---|---|---|---|---|
| 3,697,220 | A | 10/1972 | Schwartz | |
| 4,406,809 | A | 9/1983 | Hasenclever | |
| 5,942,007 | A | 8/1999 | Berndt et al. | |
| 6,524,562 | B2 * | 2/2003 | Guskey | 424/65 |
| 6,660,703 | B2 * | 12/2003 | Scheper | 510/285 |
| 6,803,034 | B2 * | 10/2004 | DuVal et al. | 424/76.2 |
| 6,894,014 | B2 * | 5/2005 | Deak et al. | 510/285 |
| 6,908,962 | B1 * | 6/2005 | Frankenbach et al. | 524/588 |
| 7,018,966 | B2 * | 3/2006 | Stoessel et al. | 510/283 |
| 2002/0115581 | A1 * | 8/2002 | DuVal et al. | 510/276 |
| 2002/0131947 | A1 * | 9/2002 | Nakanishi | 424/70.12 |

FOREIGN PATENT DOCUMENTS

| | | |
|---|---|---|
| DE | 2 010 809 | 9/1971 |
| GB | 1 067 064 A | 5/1967 |
| WO | WO 03/000833 A1 | 1/2003 |
| WO | WO 03/006733 A1 | 1/2003 |
| WO | WO 03/008698 A1 | 1/2003 |

OTHER PUBLICATIONS

International Search Report.

* cited by examiner

*Primary Examiner*—Charles Boyer
(74) *Attorney, Agent, or Firm*—Kim W. Zerby; Steven W. Miller

(57) ABSTRACT

Compositions for treating fabric articles, especially articles of clothing, linens and drapery, wherein the compositions provide improved cleaning of soils from and/or care of and/or treatment of fabric articles, especially while providing superior garment care for articles sensitive to water as compared to conventional fabric article treating compositions, are provided.

12 Claims, No Drawings

FABRIC CARE COMPOSITIONS FOR LIPOPHILIC FLUID SYSTEMS INCORPORATING AN ANTIMICROBIAL AGENT

CROSS REFERENCE TO RELATED APPLICATION

This application is a Continuation Application of co-pending U.S. application Ser. No. 10/877,539, filed on Jun. 25, 2004, now abandoned which claims priority under 37 U.S.C. § 119(e) to U.S. Provisional Application Ser. No. 60/483,350, filed Jun. 27, 2003.

FIELD OF THE INVENTION

The present invention relates to compositions containing an antimicrobial agent for treating fabric articles, especially articles of clothing, linens and drapery, wherein the compositions provide improved cleaning of soils from and/or care of and/or treatment of fabric articles, especially while providing superior garment care for articles sensitive to water as compared to conventional fabric article treating compositions.

BACKGROUND OF THE INVENTION

For the cleaning of fabric articles consumers currently have the choice of conventional laundry cleaning or dry cleaning.

Conventional laundry cleaning is carried out with relatively large amounts of water, typically in a washing machine at the consumer's home, or in a dedicated place such as a coin laundry. Although washing machines and laundry detergents have become quite sophisticated, the conventional laundry process still exposes the fabric articles to a risk of dye transfer and shrinkage. Significant portions of fabric articles used by consumers are not suitable for cleaning in a conventional laundry process. Even fabric articles that are considered "washing machine safe" frequently come out of the laundry process badly wrinkled and require ironing.

Dry cleaning processes rely on non-aqueous solvents for cleaning. By avoiding water these processes minimize the risk of shrinkage and wrinkling; however, cleaning of soils, particularly water-based and alcohol-based soils, is very limited with these processes. Typically, the dry-cleaner removes such soils by hand prior to the dry-cleaning process. These methods are complex, requiring a wide range of compositions to address the variety of stains encountered, very labor intensive and often result in some localized damage to the treated article.

Accordingly there is an unmet need, in commercial laundry, in dry-cleaning and in the home, for fabric article treating compositions, which simultaneously provide acceptable cleaning of across a variety of soils while remaining safe for a wide range of fabric articles.

SUMMARY OF THE INVENTION

The present invention provides compositions which exhibit improved cleaning of soils from and/or care of and/or treatment of fabric articles. These benefits may be delivered to the fabric article treated by the compositions of the present invention while maintaining excellent fabric care properties.

In one aspect of the present invention, a fabric article treating composition comprises:

a) a lipophilic fluid; and
b) an antimicrobial agent; and
c) a surfactant component capable of enhancing soil removal benefits of a lipophilic fluid and/or capable of suspending water in a lipophilic fluid; and
d) optionally, a non-silicone additive capable of further enhancing soil removal by the composition; and
e) optionally, water; and
f) optionally, other cleaning adjuncts; and
g) optionally, processing aids;

wherein the surfactant component comprises at least one nonionic surfactant and at least one siloxane-based surfactant.

In another aspect of the present invention, a consumable detergent composition comprises:

a) a surfactant component comprising at least one nonionic surfactant and at least one siloxane-based surfactant; and
b) an antimicrobial agent; and
c) optionally, a non-silicone additive capable of further enhancing soil removal by the composition; and
d) optionally, a polar solvent; and
e) optionally, other cleaning adjuncts; and
f) optionally, lipophilic fluid; and wherein the composition is capable of suspending water in a lipophilic fluid.

These and other aspects, features and advantages will become apparent to those of ordinary skill in the art from reading the following detailed description and the appended claims. All percentages, ratios and proportions herein are by weight, unless otherwise specified. All temperatures are in degrees Celsius (° C.) unless otherwise specified. All measurements are in SI units unless otherwise specified. All documents cited are, in relevant part, incorporated herein by reference.

DETAILED DESCRIPTION OF THE INVENTION

Definitions

The term "fabric article" used herein is intended to mean any article that is customarily cleaned in a conventional laundry process or in a dry cleaning process. As such, the term encompasses articles of clothing, linens, drapery, and clothing accessories. The term also encompasses other items made in whole or in part of fabric, such as tote bags, furniture covers, tarpaulins and the like.

The term "fabric article treating composition" used herein is intended to mean any lipophilic fluid-containing composition containing cleaning and/or care additives that comes into direct contact with fabric articles to be cleaned. It should be understood that the term "fabric article treating composition" encompasses uses other than cleaning, such as conditioning and sizing. Furthermore, optional cleaning adjuncts such as additional surfactants other than those surfactants described above, bleaches, and the like may be added to the "fabric article treating composition". That is, cleaning adjuncts may be optionally combined with the lipophilic fluid. These optional cleaning adjuncts are described in more detail herein below. Such cleaning adjuncts may be present in the fabric article treating compositions of the present invention at a level of from about 0.01% to about 10% by weight of the fabric article treating composition.

The term "soil" means any undesirable substance on a fabric article that is desired to be removed. By the terms "water-based" or "hydrophilic" soils, it is meant that the soil comprised water at the time it first came in contact with the fabric article, or the soil retains a significant portion of water on the fabric article. Examples of water-based soils include, but are not limited to, beverages, many food soils, water soluble dyes, bodily fluids such as sweat, urine or blood, and outdoor soils such as grass stains and mud.

The term "capable of suspending water in a lipophilic fluid" means that a material is able to suspend, solvate and/or emulsify water, in a way that the water remains visibly suspended, solvated or emulsified when left undisturbed for a period of at least five minutes after initial mixing of the components. In some examples of compositions in accordance with the present invention, the compositions may be colloidal in nature and/or appear milky. In other examples of compositions in accordance with the present invention, the compositions may be transparent.

The term "insoluble in a lipophilic fluid" means that when added to a lipophilic fluid, a material physically separates from the lipophilic fluid (i.e. settle-out, flocculate, float) within 5 minutes after addition, whereas a material that is "soluble in a lipophilic fluid" does not physically separate from the lipophilic fluid within 5 minutes after addition.

The term "consumable detergent composition" means any detersive composition, that when combined with a discrete lipophilic fluid, results in a fabric article treating composition according to the present invention.

The term "processing aid" refers to any material that renders the consumable detergent composition more suitable for formulation, stability, and/or dilution with a lipophilic fluid to form a fabric article treating composition in accordance with the present invention.

The term "mixing" as used herein means combining two or more materials (i.e., more specifically a discrete lipophilic fluid and a detergent composition in accordance with the present invention) in such a way that a homogeneous mixture or stable dispersion or suspension is formed. Suitable mixing processes are known in the art. Nonlimiting examples of suitable mixing processes include vortex mixing processes and static mixing processes.

"Solvent compatibility group", as used herein, means any hydrocarbon, silicone, polyalkylene oxide (ethoxy, propoxy, butoxy, etc. and mixtures) or flurorinated groups. Hydrocarbon groups may be linear, cyclic, branched, saturated or unsaturated straight and branched chain linear aliphatic; saturated and unsaturated cyclic aliphatic, including heterocyclic aliphatic; or mononuclear or polynuclear aromatics, including heterocyclic aromatics. Polyoxyalkylene groups may comprise of one or more or a mixture of alkoxy repeat units. Silicone and fluorinated groups may consist of one or more or a mixture of repeat units.

"Functionalized", as used herein, means the indicated solvent compatibility groups are chemically bonded to the polyol.

A "functional unit", as used herein, means one solvent compatibility group used to functionalize the polyol.

COMPOSITIONS OF THE PRESENT INVENTION

The present invention provides compositions which exhibit improved cleaning of soils (i.e., removal and/or reduction of soils) from and/or care of and/or treatment of fabric articles. These benefits may be delivered to the fabric article treated by the compositions of the present invention while maintaining excellent fabric care properties.

Lipophilic Fluid

"Lipophilic fluid" as used herein means any liquid or mixture of liquid that is immiscible with water at up to 20% by weight of water. In general, a suitable lipophilic fluid can be fully liquid at ambient temperature and pressure, can be an easily melted solid, e.g., one that becomes liquid at temperatures in the range from about 0° C. to about 60° C., or can comprise a mixture of liquid and vapor phases at ambient temperatures and pressures, e.g., at 25° C. and 1 atm. pressure.

It is preferred that the lipophilic fluid herein be non-flammable or, have relatively high flash points and/or low VOC characteristics, these terms having conventional meanings as used in the dry cleaning industry, to equal or, preferably, exceed the characteristics of known conventional dry cleaning fluids.

Non-limiting examples of suitable lipophilic fluid materials include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

"Siloxane" as used herein means silicone fluids that are non-polar and insoluble in water or lower alcohols. Linear siloxanes (see for example U.S. Pat. Nos. 5,443,747, and 5,977,040) and cyclic siloxanes are useful herein, including the cyclic siloxanes chosen from octamethyl-cyclotetrasiloxane (tetramer), dodecamethyl-cyclohexasiloxane (hexamer), and preferably decamethyl-cyclopentasiloxane (pentamer, commonly referred to as "D5"). A preferred siloxane comprises more than about 50% cyclic siloxane pentamer, more preferably more than about 75% cyclic siloxane pentamer, most preferably at least about 90% of the cyclic siloxane pentamer. Also preferred for use herein are siloxanes that are a mixture of cyclic siloxanes having at least about 90% (preferably at least about 95%) pentamer and less than about 10% (preferably less than about 5%) tetramer and/or hexamer.

The lipophilic fluid can include any fraction of dry-cleaning solvents, especially newer types including fluorinated solvents, or perfluorinated amines. Some perfluorinated amines such as perfluorotributylamines, while unsuitable for use as lipophilic fluid, may be present as one of many possible adjuncts present in the lipophilic fluid-containing composition.

Other suitable lipophilic fluids include, but are not limited to, diol solvent systems e.g., higher diols such as $C_6$ or $C_8$ or higher diols, organosilicone solvents including both cyclic and acyclic types, and the like, and mixtures thereof.

Non-limiting examples of low volatility non-fluorinated organic solvents include for example OLEAN® and other polyol esters, or certain relatively nonvolatile biodegradable mid-chain branched petroleum fractions.

Non-limiting examples of glycol ethers include propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether.

Non-limiting examples of other silicone solvents, in addition to the siloxanes, are well known in the literature, see, for example, Kirk Othmer's Encyclopedia of Chemical Technology, and are available from a number of commercial sources, including GE Silicones, Toshiba Silicone, Bayer, and Dow Corning. For example, one suitable silicone solvent is SF-1528 available from GE Silicones.

Non-limiting examples of suitable glycerine derivative solvents for use in the methods and/or apparatuses of the present invention include glycerine derivatives having the following structure:

Structure I

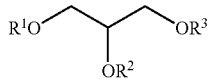

wherein $R^1$, $R^2$ and $R^3$ are each independently selected from: Hydrogen; branched or linear, substituted or unsubstituted $C_1$–$C_{30}$ alkyl, $C_2$–$C_{30}$ alkenyl, $C_1$–$C_{30}$ alkoxycarbonyl, $C_3$–$C_{30}$ alkyleneoxyalkyl, $C_1$–$C_{30}$ acyloxy, $C_7$–$C_{30}$ alkylenearyl; $C_4$–$C_{30}$ cycloalkyl; $C_6$–$C_{30}$ aryl; and mixtures thereof. Two or more of $R^1$, $R^2$ and $R^3$ together can form a $C_3$–$C_8$ aromatic or non-aromatic, heterocyclic or non-heterocyclic ring.

Non-limiting examples of suitable glycerine derivative solvents further include 2,3-bis(1,1-dimethylethoxy)-1-propanol; 2,3-dimethoxy-1-propanol; 3-methoxy-2-cyclopentoxy-1-propanol; 3-methoxy-1-cyclopentoxy-2-propanol; carbonic acid (2-hydroxy-1-methoxymethyl)ethyl ester methyl ester; glycerol carbonate and mixtures thereof.

Non-limiting examples of other environmentally-friendly solvents include lipophilic fluids that have an ozone reactivity of from about 0 to about 0.31, lipophilic fluids that have a vapor pressure of from about 0 to about 0.1 mm Hg, and/or lipophilic fluids that have a vapor pressure of greater than 0.1 mm Hg, but have an ozone reactivity of from about 0 to about 0.31. Non-limiting examples of such lipophilic fluids that have not previously been described above include carbonate solvents (i.e., methyl carbonates, ethyl carbonates, ethylene carbonates, propylene carbonates, glycerine carbonates) and/or succinate solvents (i.e., dimethyl succinates).

"Ozone Reactivity" as used herein is a measure of a VOC's ability to form ozone in the atmosphere. It is measured as grams of ozone formed per gram of volatile organics. A methodology to determine ozone reactivity is discussed further in W. P. L. Carter, "Development of Ozone Reactivity Scales of Volatile Organic Compounds", Journal of the Air & Waste Management Association, Vol. 44, Page 881–899, 1994. "Vapor Pressure" as used can be measured by techniques defined in Method 310 of the California Air Resources Board.

Preferably, the lipophilic fluid comprises more than 50% by weight of the lipophilic fluid of cyclopentasiloxanes, ("D5") and/or linear analogs having approximately similar volatility, and optionally complemented by other silicone solvents.

Surfactants

The surfactant suitable for use in the present invention has the general formula:

$$Y_u\text{-}(L_t\text{-}X_v)_x\text{-}Y'_w \quad \text{(I)}$$

$$L_y\text{-}(X_v\text{-}Y_u)_x\text{-}L'_z \quad \text{(II)}$$

and mixtures thereof;

wherein L and L' are solvent compatibilizing (or lipophilic) moieties, which are independently selected from:

(a) C1–C22 alkyl or C4–C12 alkoxy, linear or branched, cyclic or acyclic, saturated or unsaturated, substituted or unsubstituted;

(b) siloxanes having the formula:

$$M_aD_bD'_cD''_d$$

wherein a is 0–2; b is 0–1000; c is 0–50; d is 0–50, provided that a+c+d is at least 1;

M is $R^1_{3-e}X_eSiO_{1/2}$ wherein $R^1$ is independently H, or an alkyl group, X is hydroxyl group, and e is 0 or 1;

D is $R^4_2SiO_{2/2}$ wherein $R^4$ is independently H or an alkyl group;

D' is $R^5_2SiO_{2/2}$ wherein $R^5$ is independently H, an alkyl group or $(CH_2)_f(C_6Q_4)_gO—(C_2H_4O)_h—(C_3H_6O)_i(C_kH_{2k})_j$-$R^3$, provided that at least one $R^5$ is $(CH_2)_f(C_6Q_4)_gO—(C_2H_4O)_h—(C_3H_6O)_i(C_kH_{2k})_j$-$R^3$, wherein $R^3$ is independently H, an alkyl group or an alkoxy group, f is 1–10, g is 0 or 1, h is 1–50, i is 0–50, j is 0–50, k is 4–8; $C_6Q_4$ is unsubstituted or substituted; Q is independently selected from H, $C_{1-10}$ alkyl, $C_{2-10}$ alkenyl, and mixtures thereof; and D" is $R^6_2SiO_{2/2}$ wherein $R^6$ is independently H, an alkyl group or $(CH_2)_l(C_6Q_4)_m(A)_n$-$[(T)_o$-$(A')_p$-$]_q$-$(T')_rZ(G)_s$, wherein 1 is 1–10; m is 0 or 1; n is 0–5; o is 0–3; p is 0 or 1; q is 0–10; r is 0–3; s is 0–3; $C_6Q_4$ is unsubstituted or substituted; Q is independently selected from H, $C_{1-10}$ alkyl, $C_{2-10}$ alkenyl, and mixtures thereof; A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; T and T' are each independently a $C_{1-30}$ straight chained or branched alkyl or alkenyl or an aryl which is unsubstituted or substituted; Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium; G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate; and D" can be capped with C1–C4 alkyl or hydroxy groups;

Y and Y' are hydrophilic moieties, which are independently selected from hydroxy; polyhydroxy; C1–C3 alkoxy; mono- or di-alkanolamine; C1–C4 alkyl substituted alkanolamine; substituted heterocyclic containing O, S, N; sulfates; carboxylate; carbonate; and when Y and/or Y' is ethoxy (EO) or propoxy (PO), it must be capped with R, which is selected from the group consisting of:

(i) a 4 to 8 membered, substituted or unsubstituted, heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

X is a bridging linkage selected from O; S; N; P; C1 to C22 alkyl, linear or branched, saturated or unsaturated, substituted or unsubstituted, cyclic or acyclic, aliphatic or aromatic, interrupted by O, S, N, P; glycidyl, ester, amido, amino, $PO_4^{2-}$, $HPO_4^-$, $PO_3^{2-}$, $HPO_3^-$, which are protonated or unprotonated;

u and w are integers independently selected from 0 to 20, provided that u+w≧1;

t is an integer from 1 to 10;

v is an integer from 0 to 10;

x is an integer from 1 to 20; and y and z are integers independently selected from 1 to 10.

Nonlimiting examples of surfactants having the above formula include:

(1) alkanolamines;

(2) phophate/phosphonate esters;

(3) gemini surfactants including, but are not limited to, gemini diols, gemini amide alkoxylates, gemini amino alkoxylates;

(4) capped nonionic surfactants;

(5) capped silicone surfactants such as nonionic silicone ethoxylates, silicone amine derivatives;

(6) alkyl alkoxylates;

(7) polyol surfactants; and mixtures thereof.

Another class of surfactant can include siloxane-based surfactants. The siloxane-based surfactants in this application may be siloxane polymers for other applications. The siloxane-based surfactants typically have a weight average molecular weight from 500 to 20,000 daltons. Such materials, derived from poly(dimethylsiloxane), are well known in the art. In the present invention, not all such siloxane-based surfactants are suitable, because they do not provide improved cleaning of soils compared to the level of cleaning provided by the lipophilic fluid itself.

Suitable siloxane-based surfactants comprise a polyether siloxane having the formula:

$$M_aD_bD'_cD''_dM'_{2-a}$$

wherein a is 0–2; b is 0–1000; c is 0–50; d is 0–50, provided that a+c+d is at least 1;

M is $R^1_{3-e}X_eSiO_{1/2}$ wherein $R^1$ is independently H, or a monovalent hydrocarbon group, X is hydroxyl group, and e is 0 or 1;

M' is $R^2_3SiO_{1/2}$ wherein $R^2$ is independently H, a monovalent hydrocarbon group, or $(CH_2)_f(C_6Q_4)_gO—(C_2H_4O)_h—(C_3H_6O)_i(C_kH_{2k})_j-R^3$, provided that at least one $R^2$ is $(CH_2)_f(C_6Q_4)_gO—(C_2H_4O)_h—(C_3H_6O)_i(C_kH_{2k})_j-R^3$, wherein $R^3$ is independently H, a monovalent hydrocarbon group or an alkoxy group, f is 1–10, g is 0 or 1, h is 1–50, i is 0–50, j is 0–50, k is 4–8; $C_6Q_4$ is unsubstituted or substituted; Q is independently selected from H, $C_{1-10}$ alkyl, $C_{1-10}$ alkenyl, and mixtures thereof;

D is $R^4_2SiO_{2/2}$ wherein $R^4$ is independently H or a monovalent hydrocarbon group;

D' is $R^5_2SiO_{2/2}$ wherein $R^5$ is independently $R^2$ provided that at least one $R^5$ is $(CH_2)_f(C_6Q_4)_gO—(C_2H_4O)_h—(C_3H_6O)_i(C_kH_{2k})_j-R^3$, wherein $R^3$ is independently H, a monovalent hydrocarbon group or an alkoxy group, f is 1–10, g is 0 or 1, h is 1–50, i is 0–50, j is 0–50, k is 4–8; $C_6Q_4$ is unsubstituted or substituted; Q is independently selected from H, $C_{1-10}$ alkyl, $C_{1-10}$ alkenyl, and mixtures thereof; and D" is $R^6_2SiO_{2/2}$ wherein $R^6$ is independently H, a monovalent hydrocarbon group or $(CH_2)_l(C_6Q_4)_m(A)_n-[(L)_o-(A')_p-]_q-(L')_rZ(G)_s$, wherein l is 1–10; m is 0 or 1; n is 0–5; o is 0–3; p is 0 or 1; q is 0–10; r is 0–3; s is 0–3; $C_6Q_4$ is unsubstituted or substituted; Q is independently selected from H, $C_{1-10}$ alkyl, $C_{1-10}$ alkenyl, and mixtures thereof; A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; L and L' are each independently a $C_{1-30}$ straight chained or branched alkyl or alkenyl or an aryl which is unsubstituted or substituted; Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium; G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate.

Examples of the types of siloxane-based surfactants described herein above may be found in EP-1,043,443A1, EP-1,041,189 and WO-01/34,706 (all to GE Silicones) and U.S. Pat. Nos. 5,676,705, 5,683,977, 5,683,473, and EP-1,092,803A1 (all assigned to Lever Brothers).

Nonlimiting commercially available examples of suitable siloxane-based surfactants are TSF 4446 (ex. General Electric Silicones), XS69-B5476 (ex. General Electric Silicones); Jenamine HSX (ex. DelCon) and Y12147 (ex. OSi Specialties).

Yet another preferred class of materials suitable for the surfactant component is organic in nature. Preferred materials are organosulfosuccinate surfactants, with carbon chains of from about 6 to about 20 carbon atoms. Most preferred are organosulfosuccinates containing dialkly chains, each with carbon chains of from about 6 to about 20 carbon atoms. Also preferred are chains containing aryl or alkyl aryl, substituted or unsubstituted, branched or linear, saturated or unsaturated groups. Nonlimiting commercially available examples of suitable organosulfosuccinate surfactants are available under the trade names of Aerosol OT® and Aerosol TR-70® (ex. Cytec).

The surfactant component, when present in the compositions of the present invention, preferably comprises from about 1% to about 99%, more preferably 2% to about 75%, even more preferably from about 5% to about 60% by weight of the composition.

When the composition is diluted with a lipophilic fluid to prepare the wash liquor, the surfactant component preferably comprises from about 0.01% to about 10%, more preferably from about 0.02% to about 5%, even more preferably from about 0.05% to about 2% by weight of the wash liquor.

Antimicrobial Agents

Various antimicrobial agents can be added to the compositions of the present invention. Any antimicrobial agent capable of reducing the level of microbes within the compositions of the present invention can be utilized. It is believed that by reducing the level of the bacteria, potential odiferous compounds resulting from the metabolic activities of the microbes would be reduced. Particularly important microbes to reduce include, but are not limited to; gram positive bacteria such as *Staphylococcus aureus* and gram positive spore formers, such as *Bacillus subtilis*; gram negative bacteria such as *Escherichia coli*; and airborne molds and fungi such as *Aspergillus niger*, and mixtures thereof.

Any method of delivering the antimicrobial agent to the lipophilic fluid can be utilized. In one preferred method, the antimicrobial agent is solubilized prior to contacting the lipophilic fluid. In another preferred method an insoluble antimicrobial agent in the form of particulates, are delivered to the lipophilic fluid.

Antimicrobial agents of the present invention preferably comprise from about 0.01% to about 20%, even more preferably from about 1% to about 15%.

Any antimicrobial agent suitable for fabric care can be used. Such antimicrobial agents include, but are not limited to the following: Acetylsalicylic acid, n-Alkyl (68% C12, 32% C14) dimethyl dimethylbenzyl ammonium, amine acetate, amine hydrochloride, 1-(Alkyl, amino)-3-aminopropane, 1-(Alkyl, amino)-3-aminopropane, 1-(Alkyl, amino)-3-aminopropane diacetate, (as in fatty acids, 1-(Alkyl, amino)-3-aminopropane hydroxyacetate, 1-(Alkyl, amino)-3-aminopropane monoacetate, Alkyl, dimethyl 1-naphthylmethyl ammonium, dimethyl benzyl ammonium chloride, dimethyl benzyl ammonium, dimethyl benzyl ammonium saccharinate, dimethyl dimethylbenzyl ammonium chloride, dimethyl ethyl ammonium bromide, dimethyl ethylbenzyl ammonium chloride, alpha-Alkyl-omega-hydroxypoly(oxyethylene)-iodine complex, 4-tert-Amylphenol, p-tert-Amylphenol, potassium salt, p-tert-Amylphenol, sodium salt, Barium metaborate, Basic copper chloride, 1,2-Benzenedicarboxaldehyde, 1,2-Benzisothiazolin-3-one, 2-Benzyl-4-chlorophenol, 1,4-Bis(bromoacetoxy)-2-butene, Bis(tributyltin) oxide, Bis(trichloromethyl), sulfone, Borax ($B_4Na_2O_7.10H_2O$) (1303-96-4), Boric acid, Boron sodium oxide ($B_4Na_2O_7$) pentahydrate, Boron sodium oxide ($B_8Na_2O_{13}$) tetrahydrate (12280-03-4), Bromine, Bromine chloride, 1-Bromo-1-(bromomethyl)-1,3-propanedicarbonitrile, 2-Bromo-2nitropropane-1,3-diol, 1-Bromo-3-chloro-5,5-dimethylhydantoin, 2-Bromo-4'-hydroxyacetophenone, beta-Bromo-beta-nitrostyrene, 1-Butanethiol, Butoxypolypropoxypolyethoxyethanol—iodine complex, 2-tert-Butylamino-4-chloro-6-ethylamino-s-triazine, (Butylcarbityl)(6-propylpiperonyl) ether 80%, Calcium hypochlorite, Capric acid, Caprylic acid, Chlorhexidine diacetate, Chlorinated trisodium phosphate, Chlorine, Chlorine dioxide, 5-Chloro-2-(2,4-dichlorophenoxy)phenol, 5-Chloro-2-methyl-3(2H)-isothiazolone, (Z)-1-(3-Chloro-2-propenyl)-3,5,7-triaza-1-azoniatricyclo(3,3,4-Chloro-3,5-xylenol, 4-Chloro-3-cresol, 1-(3-Chloroallyl)-3,5,7-triaza-1-azoniaadamantane chloride, Chromic acid, Citric acid, Copper (metallic), Copper oxychloride ($Cu_2Cl(OH)_3$), Copper sulfate, Creosote oil, Cupric oxide, Cuprous oxide, Decyl isononyl dimethyl ammonium chloride, 2-(Decylthio)ethanamine hydrochloride, Dialkyl, methyl benzyl ammonium chloride, (60% C14, 30% C16, 2,2-Dibromo-3-nitrilopropionamide, 1,3-Dibromo-5,5-dimethylhydantoin, 4,5-Dichloro-2-n-octyl-3(2H)-isothiazolone, 1,3-Dichloro-5,5-dimethylhydantoin, 1,3-Dichloro-5-ethyl-5-methylhydantoin, Dichloro-s-triazinetrione, 1-((2-(2,4-Dichlorophenyl)-4-propyl-1,3-dioxolan-2-yl)methyl), Didecyl dimethyl ammonium chloride, N,N-Didecyl-N-methyl-3-(trimethoxysilyl)propanaminium chlorid, Dihydro-5-pentyl-2(3H)-furanone, Diiodomethyl p-tolyl sulfone, Diisobutylcresoxyethoxyethyl dimethyl benzyl ammonium chlorid, Diisobutylphenoxyethoxyethyl dimethyl benzyl ammonium chlorid, Dimethyl phthalate, 2,6-Dimethyl-m-dioxan-4-ol acetate, 1,3-Dimethylol-5,5-dimethylhydantoin, 4,4-Dimethyloxazolidine, Dioctyl dimethyl ammonium chloride, Disodium, anodithioimidocarbonate, Disodium ethylenebis(dithiocarbamate), 3H-1,2-Dithiol-3-one, 4,5-dichloro-Dodecyl bis(2-hydroxyethyl) octyl hydrogen ammonium phosphate, Dodecyl bis(hydroxyethyl)dioctyl ammonium phosphate, Dodecylbenzenesulfonic acid, Dodecylguanidine acetate, Dodecylguanidine hydrochloride, Ethanol, Ethyl sulfide, 4,4'-(2-Ethyl-2-nitrotrimethylene)dimorpholine, 7a-Ethyldihydro-1H,3H,5H-oxazolo(3,4-c)oxazole, Ethylene oxide, Ethylenediaminetetraacetic acid, Formaldehyde, Glutaraldehyde, 5-Heptyldihydro-2(3H-furanone, Hexahydro-1,3,5-tris(2-hydroxyethyl)-s-triazine, Hydrogen chloride (hydrochloric acid, anhydrous), Hydrogen peroxide, 1-Hydroxy-2-(1H)-pyridinethione, sodium salt, 1-(2-Hydroxyethyl)-2-alkyl-2-imidazoline (as in fatty acids o, 5-Hydroxymethoxymethyl-1-aza-3,7-dioxabicyclo(3.3.0)octane, 2-(Hydroxymethyl)-2-nitro-1,3-propanediol, 2-((Hydroxymethyl)amino)-2-methyl-1-propanol, 2-((Hydroxymethyl)amino)ethanol, 5-Hydroxymethyl-1-aza-3,7-dioxabicyclo(3.3.0)octane, 5-Hydroxypoly(methyleneoxy) methyl-1-aza-3,7-dioxabicyclo(3, S-(2-Hydroxypropyl) thiomethanesulfonate, 5-Hydroxytetracycline monohydrochloride, Iodine, Iodine—potassium iodide complex, 3-Iodo-2-propynyl butylcarbamate, Isopropanol, L-Lactic acid, Limonene, Lithium hypochlorite, Manganese ethylenebis(dithiocarbamate), 2-Mercaptobenzothiazole, sodium salt, 2-Mercaptobenzothiazole, zinc salt, Methanol, (2-(dihydro-5-methyl-3(2H)-oxazolyl)-1-methyl)eth, Methyl alcohol, Methyl bromide, Methyl salicylate, 2-Methyl-3(2H)-isothiazolone, 2-Methyl-4,5-trimethylene-4-isothiazolin-3-one, 2-Methyl-4-oxo-3-(2-propenyl)-2-cyclopenten-1-yl 2,2-dimethyl, Methyldodecylbenzyl trimethyl ammonium chloride 80% and methyl, Methylenebis(thiocyanate), 2,2'-(1-Methyltrimethylenedioxy)bis(4-methyl-1,3,2-dioxaborin, Monomethylol-5,5-dimethylhydantoin, Nitrilotriacetic acid, trisodium salt, 4-(2-Nitrobutyl)morpholine, Nonanoic acid, Nonylphenoxypolyethoxyethanol—iodine complex, N-Octyl bicycloheptene dicarboximide, Octyl decyl dimethyl ammonium chloride, 2-Octyl-3(2H)-isothiazolone, jasmine, 7-Oxabicyclo(2.2.1)heptane-2,3-dicarboxylic acid, 2,2'-Oxybis(4,4,6-trimethyl-1,3,2-dioxaborinane), 10,10'-Oxybisphenoxarsine, Oxydiethylenebis(alkyl dimethyl ammonium chloride), Paradichlorobenzene, Paraformaldehyde, Peroxyacetic acid, Phenol, (3-Phenoxyphenyl)methyl d-cis and trans, 2,2-dimethyl-3-(2-methyl, o-Phenylphenol, o-Phenylphenol, potassium salt, Phosphoric acid, Phosphoric acid, bis(2-ethylhexyl) ester, compd. with 2,2'-(c, Phosphoric acid, mono(2-ethylhexyl) ester, Phosphoric acid, mono(2-ethylhexyl) ester, Pine oil, Poly(iminoimidocarbonyliminoimidocarbonyliminohexamethylene), poly(oxyethylene(dimethyliminio)ethylene(dimethyliminio)ethyl, Polyethoxypolypropoxyethanol—iodine complex, Polyvinylpyrrolidone—iodine complex, Potassium 2-benzyl-4-chlorophenate, Potassium N-hydroxymethyl-N-methyldithiocarbamate, Potassium N-methyldithiocarbamate, Potassium cresylate, Potassium dimethyldithiocarbamate, Potassium iodide, Potassium permanganate, Potassium peroxymonosulfate, Potassium salts of fatty acids, 1,2-Propanediol, Propanol, 2-Propenal, Propionic acid, Propylene oxide, *Pseudomonas Syringae* 742RS, *Pseudomonas fluorescens* 1629RS, *Pseudomonas fluorescens* A506 (previously coded 006418), Putrescent whole egg solids, 1H-Pyrazole-1-methanol, 3,5-dimethyl-(9CI), Pyrethrins, 1H-Pyrrole-3-carbonitrile, 4-(2,2-difluoro-1,3-benzodioxol-4-, Silver, Silver nitrate, Silver oxide, Soap, Sodium 2-benzyl-4-chlorophenate, Sodium N-methyldithiocarbamate, Sodium bisulfate, Sodium bromide, Sodium carbonate, Sodium chlorate, Sodium chloride, Sodium chlorite, Sodium dichloro-s-triazinetrione, Sodium dichloroisocyanurate dihydrate, Sodium dimethyldithiocarbamate, Sodium dodecylbenzenesulfonate, Sodium hypochlorite, Sodium metasilicate, Sodium o-phenylphenate, Sodium perborate monohydrate, Sodium phenate, Sodium tetrahydro-3,5-dimethyl-2H-1,3,5-thiadiazine-2-thione, Streptomycin sulfate, Sulfonated oleic acid, sodium salt, Sulfuric acid, Tetrachloroisophthalonitrile, Tetraglycine hydroperiodide, Tetrahydro-3,5-dimethyl-2H-1,3,5-thiadiazine-2-thione, Tetrakis(hydroxymethyl)phosphonium sulphate (THPS), Tetrasodium, thylenediaminetetraacetate, 2-(4'-Thiazolyl)benzimidazole, 2 Thiocyanomethylthio)benzothiazole, Thymol, 3,5,7 Triazoniatricyclo (3.3.1.1(superscript3,7))decane, Tributyltin benzoate, Tributyltin maleate, Trichloro-s-triazinetrione, Trichloromelamine, cis-N-Trichloromethylthio-4-cyclohexene-1,2-dicarboximide, Triethanolamine dodecylbenzenesulfonate, Triethylene glycol, 1,3,5-Triethylhexahydro-s-triazine, 3-(Trimethoxysilyl)propyl dimethyl octadecyl ammonium chlorid, Tris(2-hydroxyethyl)amine, Trisodium (2-hydroxyethyl)ethylenediaminetriacetate, Trisodium phosphate, Zinc, Zinc 2-pyridinethiol-1-oxide, Zinc dimethyldithiocarbamate, Zinc oxide, and mixtures thereof.

Preferred antimicorbial agents are o-phenylphenol, Bromonitropropane diol (Bronopol), Tris (hydroxymethyl)nitromethane, Silicone Quaternary Ammonium salt (Octadecylaminodimethyltrimethoxysilylpropyl ammonium chloride), Silver Zeolite, Benzoimidazole, 2-(4-thiazolyl), Hinokitiol, Propenenitriles, Triclosan (2,4,4'-trichloro-2' hydroxy diphenyl-ether, Cyclopropyl-N'-(1,1-dimethylethyl)-6-(methylthio)-1,3,5-triazine-2,4-diamine, Zinc Oxide, Benzimidazole, 2-(4-Thiazolyl)-2,6-Dimethyl-1,3-dioxan-4-ol acetate, 1-Aza-3,7-dioxa-5-ethyl-bicyclo-(3,3,0)-octane, 2-Bromo-2-nitro-1,3-propanediol, 2-(hydroxy methyl)-2-nitro-1,3-propanediol, 2,2-dibromo-Propanediamide, 2,4,4'-Trichloro-2-hydroxydiphenyl ether, 4,4'-Dichloro-2-hydroxydiphenyl ether, Tetrakis(hydroxymethyl)phosphonium sulfate, and mixtures thereof.

Non-silicone Additive

The optional non-silicone additive (i.e., materials do not contain an Si atom), which preferably comprises a strongly polar and/or hydrogen-bonding head group, further enhances soil removal by the compositions of the present invention. Examples of the strongly polar and/or hydrogen-bonding head group-containing materials include, but are not limited to alcohols, cationic materials such as cationic surfactants, quaternary surfactants, quaternary ammonium salts such as ammonium chlorides (nonlimiting examples of ammonium chlorides are Arquad® materials commercially available from Akzo Nobel) and cationic fabric softening actives, nonionic materials such as nonionic surfactants (i.e., alcohol ethoxylates, polyhydroxy fatty acid amides), gemini surfactants, anionic surfactants, zwitterionic surfactants, carboxylic acids, sulfates, sulphonates, phosphates, phosphonates, and nitrogen containing materials. In one embodiment, non-silicone additives comprise nitrogen containing materials chosen from primary, secondary and tertiary amines, diamines, triamines, ethoxylated amines, amine oxides, amides and betaines, a nonlimiting example of a betaines is Schercotaine® materials commercially available from Scher Chemicals and mixtures thereof.

In another embodiment embodiment, alkyl chain contains branching that may help lower the melting point.

In yet another embodiment, primary alkylamines comprising from about 6 to about 22 carbon atoms are used. Particularly preferred primary alkylamines are oleylamine (commercially available from Akzo under the trade name Armeen OLD®), dodecylamine (commercially available from Akzo under the trade name Armeen 12D®), branched $C_{16}$–$C_{22}$ alkylamine (commercially available from Rohm & Haas under the trade name Primene JM-T®) and mixtures thereof.

Suitable cationic materials may include quaternary surfactants, which maybe quaternary ammonium compounds. Commercially available agents include Varisoft® materials from Goldschmidt.

Polar Solvent

Compositions according to the present invention may further comprise a polar solvent. Non-limiting examples of polar solvents include: water, alcohols, glycols, polyglycols, ethers, carbonates, dibasic esters, ketones, other oxygenated solvents, and mixutures thereof. Further examples of alcohols include: $C_1$–$C_{126}$ alcohols, such as propanol, ethanol, isopropyl alcohol, etc., benzyl alcohol, and diols such as 1,2-hexanediol. The Dowanol® series by Dow Chemical are examples of glycols and polyglycols useful in the present invention, such as Dowanol® TPM, TPnP, DPnB, DPnP, TPnB, PPh, DPM, DPMA, DB, and others. Further examples include propylene glycol, butylene glycol, polybutylene glycol and more hydrophobic glycols. Examples of carbonate solvents are ethylene, propylene and butylene carbonantes such as those available under the Jeffsol® tradename. Polar solvents for the present invention can be further identified through their dispersive ($\delta_D$), polar ($\delta_P$) and hydrogen bonding ($\delta_H$) Hansen solubility parameters. Preferred polar solvents or polar solvent mixtures have fractional polar ($f_P$) and fractional hydrogen bonding ($f_H$) values of $f_P>0.02$ and $f_H>0.10$, where $f_P=\delta_P/(\delta_D+\delta_P+\delta_H)$ and $f_H=\delta_H/(\delta_D+\delta_P+\delta_H)$, more preferably $f_P>0.05$ and $f_H>0.20$, and most preferably $f_P>0.07$ and $f_H>0.30$.

In the detergent composition of the present invention, the levels of polar solvent can be from about 0 to about 70%, preferably 1 to 50%, even more preferably 1 to 30% by weight of the detergent composition.

Water, when present in the wash fluid fabric article treating compositions of the present invention, may comprise from about 0.001% to about 10%, more preferably from about 0.005% to about 5%, even more preferably from about 0.01% to about 1% by weight of the wash fluid fabric article treating composition.

Water, when present in the detergent compositions of the present invention, preferably comprises from about 1% to about 90%, more preferably from about 2% to about 75%, even more preferably from about 5% to about 40% by weight of the consumable detergent composition.

Processing Aids

Optionally, the compositions of the present invention may further comprise processing aids. Processing aids facilitate the formation of the fabric article treating compositions of the present invention, by maintaining the fluidity and/or homogeneity of the consumable detergent composition, and/or aiding in the dilution process. Processing aids suitable for the present invention are solvents, preferably solvents other than those described above, hydrotropes, and/or surfactants, preferably surfactants other than those described above with respect to the surfactant component. Particularly preferred processing aids are protic solvents such as aliphatic alcohols, diols, triols, etc. and nonionic surfactants such as ethoxylated fatty alcohols.

Processing aids, when present in the fabric article treating compositions of the present invention, preferably comprise from about 0.02% to about 10%, more preferably from about 0.05% to about 10%, even more preferably from about 0.1% to about 10% by weight of the fabric article treating composition.

Processing aids, when present in the consumable detergent compositions of the present invention, preferably comprise from about 1% to about 75%, more preferably from about 5% to about 50% by weight of the consumable detergent composition.

Cleaning Adjuncts

Some suitable cleaning adjuncts include, but are not limited to, builders, surfactants, other than those described above with respect to the surfactant component, enzymes, bleach activators, bleach catalysts, bleach boosters, bleaches, alkalinity sources, antibacterial agents, colorants, perfumes, pro-perfumes, finishing aids, lime soap dispersants, odor control agents, odor neutralizers, polymeric dye transfer inhibiting agents, crystal growth inhibitors, photobleaches, heavy metal ion sequestrants, anti-tarnishing agents, anti-oxidants, anti-redeposition agents, soil release polymers, electrolytes, pH modifiers, thickeners, abrasives, divalent or trivalent ions, metal ion salts, enzyme stabilizers, corrosion inhibitors, polyamines and/or their alkoxylates, suds stabilizing polymers, solvents, process aids, fabric softening agents, optical brighteners, hydrotropes, suds or foam suppressors, suds or foam boosters and mixtures thereof.

Treated Fabric Article

A fabric article that has been treated in accordance a method of the present invention is also within the scope of the present invention. Preferably such a treated fabric article comprises an analytically detectable amount of at least one compound (e.g., an organosilicone) having a surface energy modifying effect but no antistatic effect; or an analytically detectable amount of at least one compound having a surface energy modifying and/or feel-modifying and/or comfort-modifying and/or aesthetic effect and at least one antistatic agent other than said at least one compound.

What is claimed is:

1. A fabric article treating composition comprising:

a) from about 70% to about 99.99% by weight of said composition of a lipophilic fluid comprising a cyclic siloxane;

b) from about 0.01 % to about 20% by weight of said composition of an antimicrobial agent selected from the group consisting of phenylphenol; bromonitropropane diol; tris(hydroxymethyl)nitromethane; octadecylamino-dimethyltrimethoxysilylpropyl ammonium chloride; silver zeolite; benzoimidazole, 2-(4-thiazolyl); hinokitiol; propenenitriles; 2,4,4-trichloro-2-hydroxy diphenyl ether; cyclopropyl-N-(1,1-dimethylethyl)-6-(methylthio)-1,3,5-triazine-2,4-diamine; zinc oxide; 2-(4-thiazolyl)-benzimidazole; 2,6-dimethyl-1,3-dioxan-4-ol acetate; 1-aza-3,7-dioxa-5-ethyl-bicyclo-(3,3,0)-octane; 2-(hydroxy methyl)-2-nitro-1,3-propanediol; 2,2-dibromo-propanediamide; 4,4-dichloro-2-hydroxydiphenyl ether; tetrakis (hydroxymethyl)phosphonium sulfate; and mixtures thereof;

c) a surfactant component capable of enhancing soil removal benefits of a lipophilic fluid and/or capable of suspending water in a lipophilic fluid;

d) a non-silicone alkyl amine additive capable of further enhancing soil removal by the composition;

e) optionally, a polar solvent; and f) optionally, other cleaning adjuncts, wherein the surfactant component comprises at least one siloxane-based surfactant and at least one nonionic surfactant different from the siloxane-based surfactant.

2. The fabric article treating composition according to claim 1, wherein said lipophilic fluid further comprises hydrocarbons, glycol ethers, glycerine ethers, perfluorinated solvents, hydrofluoroether solvents, low-volatility nonfluorinated organic solvents, diol solvents, and mixtures thereof.

3. The fabric article treating composition according to claim 1, wherein said lipophilic fluid comprises decamethylcyclopentasiloxane.

4. The fabric article treating composition according to claim 1, wherein said antimicrobial agent is 2,4,4'-trichloro-2'-hydroxydiphenyl ether.

5. The fabric article treating composition according to claim 1, wherein said antimicrobial agent is tetrakis(hydroxymethyl)phosphonium sulfate.

6. The fabric article treating composition according to claim 1, wherein said antimicrobial agent is 4,4'-dichloro-2-hydroxydiphenyl ether.

7. The fabric article treating composition according to claim 1, wherein said antimicrobial agent is solubilized prior to contacting the lipophilic fluid.

8. The fabric article treating composition according to claim 1, wherein said antimicrobial agent is delivered to the lipophilic fluid in the form of a particulate.

9. The fabric article treating composition according to claim 1, wherein said surfactant component comprises from about 1% to about 99% by weight of the detergent composition.

10. The fabric article treating composition according to claim 1, wherein said alkyl amine is selected from the group consisting of dodecylamine, stearylamine, oleylamine and mixtures thereof.

11. The fabric article treating composition according to claim 1, wherein said composition comprises a polar solvent comprising water.

12. The fabric article treating composition according to claim 1, wherein said composition further comprises a cleaning adjunct selected from the group consisting of: builders, additional surfactants, emulsifying agents, enzymes, bleach activators, bleach catalysts, bleach boosters, bleaches, alkalinity sources, colorants, perfume, lime soap dispersants, odor control agents, odor neutralizers, polymeric dye transfer inhibiting agents, crystal growth inhibitors, photobleaches, heavy metal ion sequestrants, anti-tarnishing agents, anti-oxidants, anti-redeposition agents, soil release polymers, electrolytes, pH modifiers, thickeners, abrasives, divalent ions, metal ion salts, enzyme stabilizers, corrosion inhibitors, diamines, suds stabilizing polymers, solvents, process aids, fabric softening agents or actives, sizing agents, optical brighteners, hydrotropes and mixtures thereof.

* * * * *

UNITED STATES PATENT AND TRADEMARK OFFICE

CERTIFICATE OF CORRECTION

PATENT NO. : 7,220,715 B2
APPLICATION NO. : 11/352804
DATED : May 22, 2007
INVENTOR(S) : Chanchal Kumar Ghosh et al.

It is certified that error appears in the above-identified patent and that said Letters Patent is hereby corrected as shown below:

Title Page (*) Notice: After Line 3, insert -- This patent is subject to a terminal disclaimer --.

Signed and Sealed this

Twenty-first Day of August, 2007

JON W. DUDAS
*Director of the United States Patent and Trademark Office*